US010940683B2

(12) United States Patent
Minamidate et al.

(10) Patent No.: US 10,940,683 B2
(45) Date of Patent: Mar. 9, 2021

(54) MANUFACTURING METHOD FOR BENT PLATE WITH PRINTED LAYER

(71) Applicant: AGC Inc., Chiyoda-ku (JP)

(72) Inventors: Jun Minamidate, Tokyo (JP); Nobuyuki Tanaka, Tokyo (JP); Tomoyuki Kobayashi, Tokyo (JP)

(73) Assignee: AGC Inc., Chiyoda-ku (JP)

( * ) Notice: Subject to any disclaimer, the term of this patent is extended or adjusted under 35 U.S.C. 154(b) by 590 days.

(21) Appl. No.: 15/634,681

(22) Filed: Jun. 27, 2017

(65) Prior Publication Data

US 2017/0368817 A1 Dec. 28, 2017

(30) Foreign Application Priority Data

Jun. 28, 2016 (JP) ..... JP2016-127637

(51) Int. Cl.

| | |
|---|---|
| ***B41F 15/00*** | (2006.01) |
| ***B41F 15/44*** | (2006.01) |
| ***B41F 15/08*** | (2006.01) |
| ***B41F 15/36*** | (2006.01) |
| *B41F 15/42* | (2006.01) |

(52) U.S. Cl.

CPC ..... *B41F 15/0895* (2013.01); *B41F 15/36* (2013.01); *B41F 15/44* (2013.01); *B41F 15/42* (2013.01)

(58) Field of Classification Search

CPC ..... B41F 15/08; B41F 15/0895; B41F 15/30; B41F 15/36; B41F 15/38; B41F 15/42; B41F 15/44; B41F 15/423; B41M 1/12; B41M 1/30; B41M 1/38; B41M 1/40

See application file for complete search history.

(56) References Cited

U.S. PATENT DOCUMENTS 4,648,317 A * 3/1987 Bubley ..... B41F 15/42 101/123
4,817,524 A * 4/1989 Riemer ..... B41F 15/42 101/123
5,090,320 A * 2/1992 Nave ..... B41F 15/0895 101/126

(Continued)

FOREIGN PATENT DOCUMENTS

JP 01-171944 * 7/1989 ..... B41F 15/40
JP 06-031895 * 2/1994 ..... B41F 15/08

(Continued)

*Primary Examiner* — Matthew G Marini
*Assistant Examiner* — Marissa Ferguson-Samreth
(74) *Attorney, Agent, or Firm* — Oblon, McClelland, Maier & Neustadt, L.L.P.

(57) ABSTRACT

The present invention relates to a manufacturing method for a bent plate with a printed layer including: holding the bent plate by bringing a second main surface of the bent plate into contact with a surface of a fixing jig in which the surface of the fixing jig has a shape corresponding to the second main surface; disposing a screen having a printing pattern portion above the bent plate; bringing a squeegee into contact with a printing start part of the bent plate via the screen; and causing the squeegee to relatively traverse the bent plate along the first main surface via the screen, in which an angle on a moving direction side of the squeegee is changed when the squeegee is caused to relatively traverse the bent plate.

24 Claims, 8 Drawing Sheets

(56) References Cited

U.S. PATENT DOCUMENTS

| | | | | | |
|---|---|---|---|---|---|
| 5,388,508 | A * | 2/1995 | Dubuit | B41F 15/44 | 101/120 |
| 5,660,875 | A * | 8/1997 | Muchi | B41F 15/085 | 427/64 |
| 6,041,702 | A * | 3/2000 | Ichikawa | B41F 15/0895 | 101/123 |
| 6,264,869 | B1 | 7/2001 | Notarpietro et al. | | |
| 6,698,345 | B2 * | 3/2004 | Cutcher | B41F 15/0895 | 101/123 |
| 7,182,019 | B2 * | 2/2007 | Cutcher | B41F 15/0895 | 101/123 |
| 8,561,535 | B2 | 10/2013 | Sabia et al. | | |
| 2004/0149152 | A1 * | 8/2004 | Edson | B41F 15/04 | 101/127 |
| 2005/0160927 | A1 * | 7/2005 | Cutcher | B41F 15/0895 | 101/127.1 |
| 2011/0209634 | A1 * | 9/2011 | Sabia | B41F 15/0895 | 101/129 |
| 2018/0264800 | A1 * | 9/2018 | Ito | B41M 1/12 | |
| 2018/0326717 | A1 * | 11/2018 | Fukazawa | B41F 15/08 | |
| 2018/0333948 | A1 * | 11/2018 | Matsuda | B41F 15/0895 | |

FOREIGN PATENT DOCUMENTS

| | | | | | |
|---|---|---|---|---|---|
| JP | 8-112891 | A | | 5/1996 | |
| JP | 09-216338 | | * | 8/1997 | B41F 15/40 |
| JP | 10-095099 | | * | 4/1998 | B41F 15/36 |
| JP | 2001-506553 | A | | 5/2001 | |
| JP | 2005-088577 | A | | 4/2005 | |
| JP | 2008-284713 | A | | 11/2008 | |
| JP | 2010-284874 | A | | 12/2010 | |
| JP | 2010284874 | | * | 12/2010 | B41F 15/42 |
| JP | 2018-192798 | | * | 12/2018 | B41F 15/04 |
| WO | 2019074800 | | * | 4/2019 | B41F 15/08 |

* cited by examiner

MANUFACTURING METHOD FOR BENT PLATE WITH PRINTED LAYER

TECHNICAL FIELD

The present invention relates to a manufacturing method for a bend plate with a printed layer, and more specifically, relates to the manufacturing method for a bent plate with a printed layer, which is capable of carrying out printing with good print dimensional precision even on a bent plate having a surface to be printed that is in a curved surface shape, or printing with excellent quality on an end surface.

BACKGROUND ART

Conventionally, it has been known a technique to perform screen-printing on a bent substrate having a curved surface shape (e.g., refer to Patent Document 1). Patent Document 1 discloses, in order to print a pattern on a surface to be printed that is in a curved surface shape, a method in which a screen plate, which contains a rectangular frame and a flat gauze (screen) having a print pattern and attached to the rectangular frame, is made opposite to the surface to be printed, and the screen is swept while being pushed by a squeegee in a state where an angle of the squeegee is kept constant to perform printing.

Patent Document 1: U.S. Pat. No. 8,561,535

SUMMARY OF THE INVENTION

However, in printing method disclosed in Patent Document 1, there is a possibility that a printing thickness varies due to variations in a pressing force exerted by a squeegee on a surface to be printed when printing is performed on a bent plate, thereby impairing print dimensional precision. Furthermore, there is a case where ink splashing occurs on an end surface of the bent plate, affecting printing quality.

The present invention is made in view of the aforementioned problems, and an object thereof is to provide a manufacturing method for a bent plate with a printed layer, which is capable of carrying out printing with a small variation in printing thickness and good print dimensional precision even on a surface to be printed of a bent plate, or printing with excellent quality on an end surface.

The above object of the present invention is accomplished through the following configurations.

(1) A manufacturing method for a bent plate with a printed layer containing a bent plate that has a first main surface and a second main surface and has a bent portion on at least a part thereof, and a printed layer that is formed on at least a part of the first main surface, the manufacturing method including:

(A) holding the bent plate by bringing the second main surface of the bent plate into contact with a surface of a fixing jig in which the surface of the fixing jig has a shape corresponding to the second main surface;

(B) disposing a screen having a printing pattern portion above the bent plate with the screen being separated from the first main surface;

(C) supplying an ink onto the screen;

(D) bringing a squeegee into contact with a printing start part of the bent plate via the screen; and (E) extruding the ink from the screen by causing the squeegee to relatively traverse the bent plate along the first main surface via the screen, in which an angle on a moving direction side of the squeegee, formed by a surface of the screen in a state of no contact with the squeegee and the squeegee in a side view, is changed when the squeegee is caused to relatively traverse the bent plate in the (E).

(2) The manufacturing method according to (1), in which the screen includes the printing pattern portion and a non-printing pattern portion, and the angle on the moving direction side of the squeegee is change in the non-printing pattern portion when the squeegee moves from the printing pattern portion to the non-printing pattern portion, in the (E).

(3) The manufacturing method according to (2), in which the angle on the moving direction side of the squeegee in the non-printing pattern portion before moving to the non-printing pattern portion, in the (E).

(4) The manufacturing method according to (2) or (3), in which the angle on the moving direction side of the squeegee is kept constant until the squeegee traverses above the printing pattern portion when the squeegee moves from the printing pattern portion to the non-printing pattern portion, in the (E).

(5) The manufacturing method according to (1), in which the angle on the moving direction side of the squeegee is changed when the squeegee is caused to relatively traverse the bent plate and moves in the printing pattern portion, in the (E), and the angle is changed with controlling such that a difference $\Delta\beta'$ between a maximum value and a minimum value of a contact angle on the moving direction side, formed by a tangential line on the first main surface at a position at which the squeegee is in contact via the screen and the squeegee, is smaller than a difference $\Delta\beta$ between a maximum value and a minimum value of the contact angle on the moving direction side in a case where an angle on the moving direction side of the squeegee is kept constant.

(6) The manufacturing method according to (5), in which the angle on the moving direction side of the squeegee is changed with continuously controlled.

(7) The manufacturing method according to (5) or (6), in which the angle on the moving direction side of the squeegee is changed with controlled so as to become larger.

(8) The manufacturing method according to any one of (5) to (7), in which the contact angle is 60 degrees or larger and 90 degrees or smaller.

(9) The manufacturing method according to (1), in which the angle on the moving direction side of the squeegee is changed such that a contact angle on the moving direction side, formed by a tangential line on the first main surface at a position at which the squeegee is in contact via the screen and the squeegee, is kept constant, when the squeegee is caused to relatively traverse the bent plate in the (E).

(10) The manufacturing method according to (9), in which the screen includes a first non-printing pattern portion, the printing pattern portion, and a second non-printing pattern portion, the printing start part is opposite to the first non-printing pattern portion in the (D), and the angle on the moving direction side of the squeegee is started to change in the first non-printing pattern portion when the squeegee moves from the first non-printing pattern portion to the printing pattern portion, in the (E).

(11) The manufacturing method according to (1), in which the screen includes the printing pattern portion and a non-printing pattern portion, and the angle on the moving direction side of the squeegee is changed such that a contact angle on the moving direction side, formed by a tangential line on the first main surface at a position at which the squeegee is in contact via the screen and the squeegee, is kept constant until the squeegee traverses above the printing pattern portion, and the angle on the moving direction side of the squeegee is changed so as to become larger in the non-printing pattern portion, when the squeegee moves from the printing pattern portion to the non-printing pattern portion in the (E).

(12) The manufacturing method according to any one of (1) to (11), in which the screen is deflected by the squeegee until the screen comes into contact with the first main surface, in the (E).

(13) The manufacturing method according to any one of (1) to (12), in which the ink extruded on the first main surface has a thickness of 20 μm or smaller in terms of a thickness of a dried printed layer, in the (E).

(14) The manufacturing method according to any one of (1) to (13), in which the second main surface is vacuum-sucked onto the surface of the fixing jig to hold the bent plate on the fixing jig, in the (A).

(15) The manufacturing method according to any one of (1) to (14), in which the first main surface has a concave shape.

(16) The manufacturing method according to any one of (1) to (14), in which the first main surface has a convex shape.

(17) The manufacturing method according to any one of (1) to (16), in which the bent portion has a radius of curvature of 10,000 mm or smaller.

(18) The manufacturing method according to any one of (1) to (17), in which the bent portion has a radius of curvature of 1 mm or larger.

(19) The manufacturing method according to any one of (1) to (18), further including:

(F) curing the ink extruded on the first main surface.

(20) The manufacturing method according to (19), in which curing of the ink is carried out by a heat treatment, in the (F).

(21) The manufacturing method according to any one of (1) to (20), in which the (B), (C), (D), and (E) are repeatedly carried out two or more times.

(22) The manufacturing method according to any one of (1) to (21), in which the bent plate is fixed and the squeegee is moved, in the (E).

(23) The manufacturing method according to any one of (1) to (21), in which the squeegee is fixed and the bent plate is moved, in the (E).

(24) The manufacturing method according to any one of (1) to (21), in which the bent plate and the squeegee are moved, in the (E).

According to the manufacturing method for a bent plate with a printed layer of the present invention, a bent plate, which has a first main surface and a second main surface and has a bent portion on at least a part thereof, is held by bringing the second main surface into contact with a surface of a fixing jig. An ink is supplied onto a screen, which is disposed above the bent plate with the screen being separated from the first main surface, a squeegee is brought into contact with a printing start part of the bent plate via the screen, then, the squeegee is caused to relatively traverse the bent plate along the first main surface to extrude the ink from the screen, to thereby form a printed layer. The angle on the moving direction side of the squeegee, which is formed by the surface of the screen in a state of no contact with the squeegee and the squeegee in a side view, is changed when the squeegee is caused to relatively traverse the bent plate. Therefore, a printed layer with small variations can be formed on the surface to be printed of the bent plate and a high-quality printed layer can be obtained.

MODE FOR CARRYING OUT THE INVENTION

Hereinafter, a manufacturing method for a bent plate with a printed layer according to each embodiment of the present invention will be described in detail based on the drawings.

First Embodiment

Figure 1:
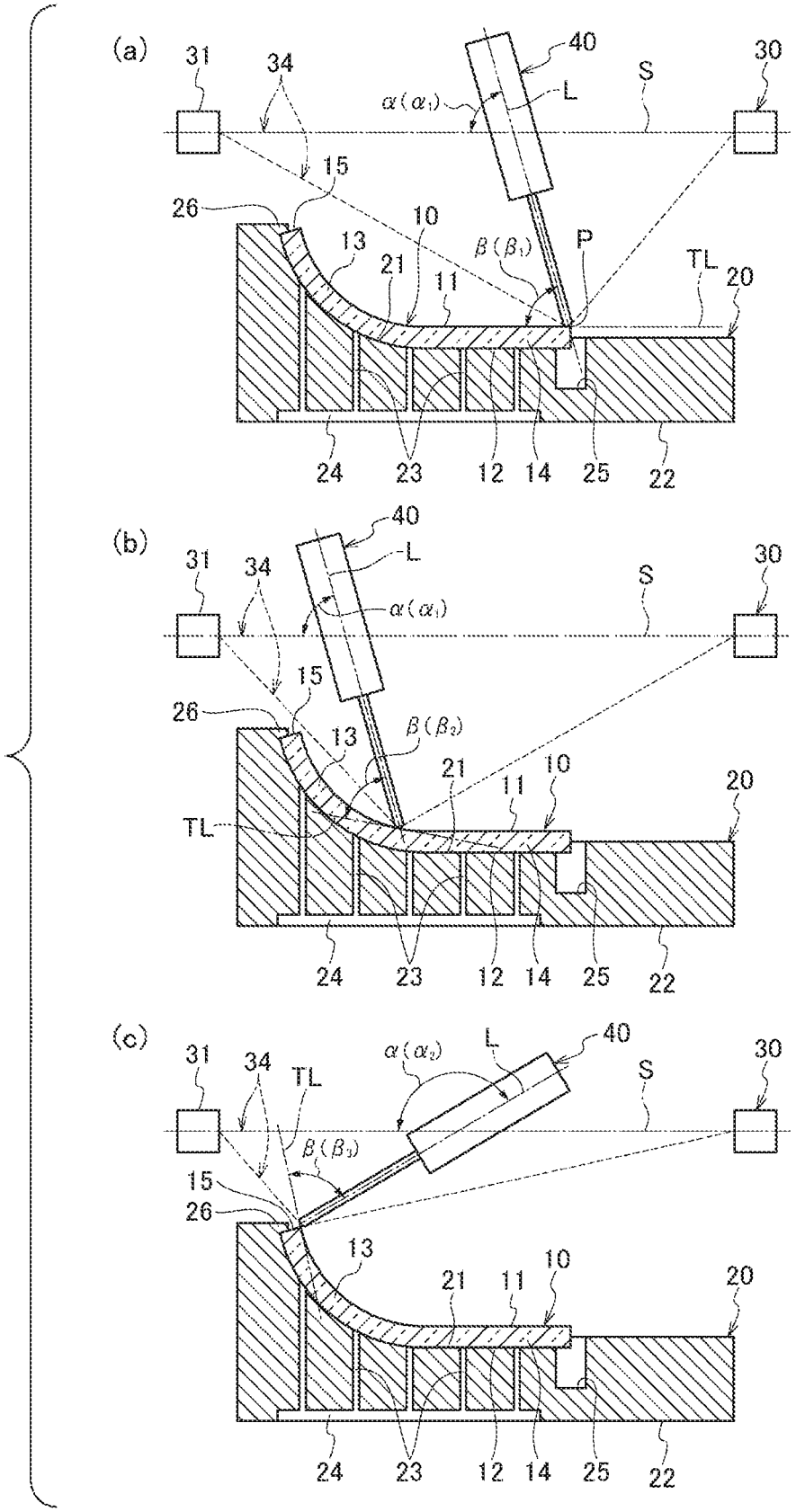
FIG. 1 includes explanatory views (a) to (c) illustrating procedures of a manufacturing method for a bent plate with a punted laser according to a first embodiment of the present invention.
Figure 2A:
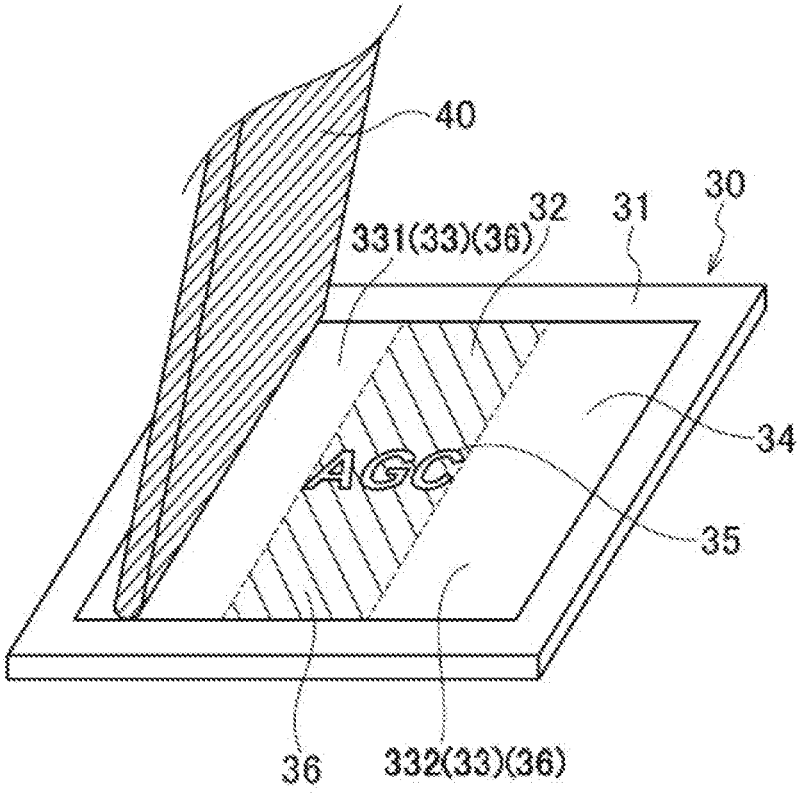
FIG. 2A is a perspective view illustrating a screen plate and a squeegee.
Figure 2B:
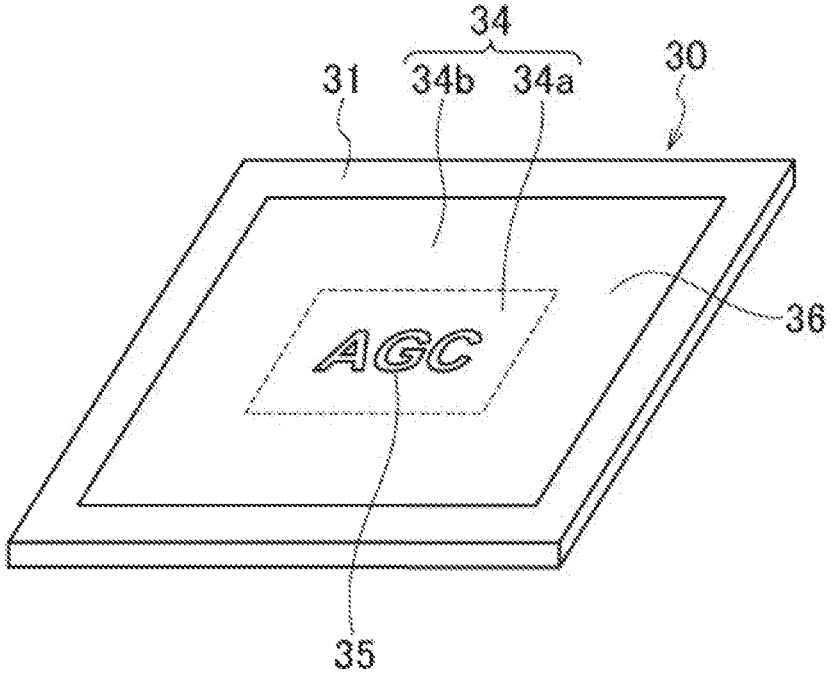
FIG. 2B is a perspective view illustrating a mixed plate that is an example of the screen plate illustrated in FIG. 2A.

As illustrated in FIG. 1, FIG. 2A and FIG. 2B, a printing apparatus used in the manufacturing method for a bent plate with a printed layer the present embodiment includes at least a fixing jig 20, a screen plate 30 and a squeegee 40, and performs screen-printing on a bent plate 10.

<Bent Plate>

The bent plate 10 has an upper surface 11 that is a first main surface serving as a surface to be printed on which a printer layer is formed, and a lower surface 12 that is a second main surface to be fixed to the fixing jig 20, and further has a bent portion 13 formed on least a part thereof. Although the bent plate 10 has the bent portion 13 and a flat portion 14 that continues from the bent portion to an end surface of the bent plate 10 in the embodiment, the bent plate 10 may have the bent portion 13 in both end portions of the flat portion 14 or may have a curved shape, which does not have the flat portion 14 and is the bent portion 13 on the whole. Recently, in a case where the bent plate 10 is used as a cover glass of a display device, it is assumed in various types of devices (televisions, personal computers, smartphones, car navigations, etc.) that a display surface of a display panel, such as a liquid crystal panel and an organic EL panel, is a curved surface. For this reason, the bent plate 10 may be made in accordance with the shape of a display panel or the shape of a housing of a display device.

Examples of the material of the bent plate 10 include inorganic glass, organic glass such as acrylic resins and polycarbonates, ceramics, resins, wood, and metal. In particular, examples of glass include crystallized glass and colored glass in addition to colorless, transparent, and amorphous glass. Glass is more preferable in the case of being used as a vehicle-mounted member from a standpoint of high heat resistance and high weather resistance. In the case where the bent plate 10 is made of glass, it is preferable that the bent plate 10 has been subjected to a strengthening treatment. The strengthening treatment can secure the required mechanical durability and abrasion resistance in the case where the bent plate 10 is used as a cover glass of an in-vehicle display device, for example. Although both physical strengthening treatment and chemical strengthening treatment can be used as the strengthening treatment, chemical strengthening treatment is preferable in that even relatively thin glass can be treated.

The bent portion 13 has a radius of curvature of preferably 1 mm or larger and 10,000 mm or smaller, and more preferably 5 mm or larger and 5,000 mm or smaller. In the case of smaller than 1 mm, the curvature is too small and it is difficult to perform screen-printing. In addition, in the case of exceeding 10,000 mm, screen printing can be performed by a screen-printing for flat surface since the bent portion is locally a substantially flat surface. The flat portion 14 can be a portion other than the bent portion 13, and is a portion having a radius of curvature exceeding 10,000 mm.

Figure 3A:
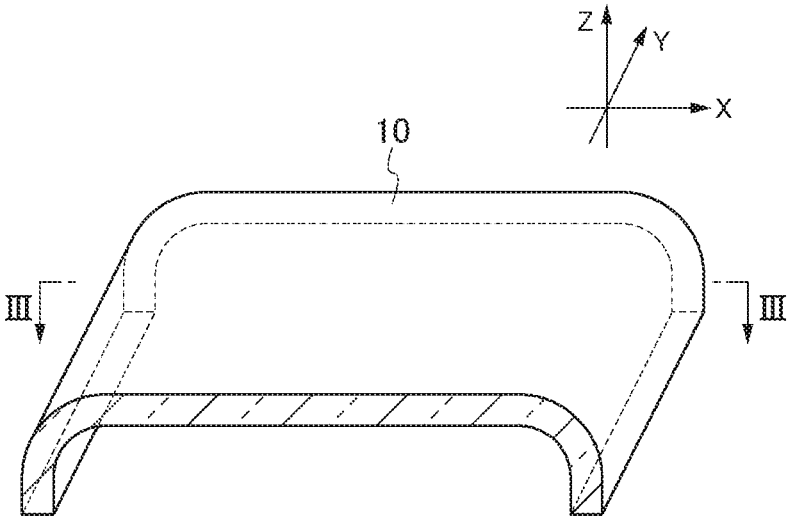
FIG. 3A is a perspective view for explaining a bending depth of the bent plate.
Figure 3B:
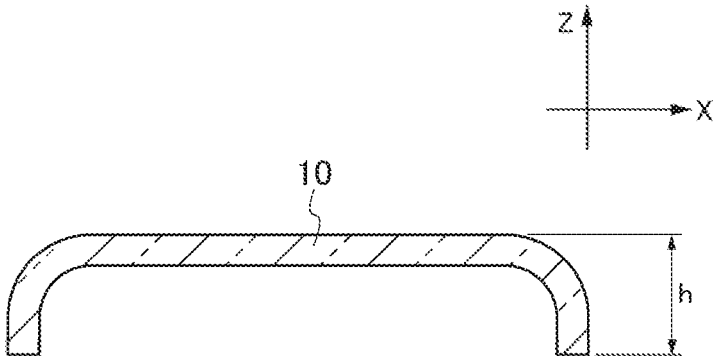
FIG. 3B is a cross-sectional view taken along line III-III of FIG. 3A.

The bent plate 10 has a bending depth h of preferably 30 mm or smaller, and more preferably 1 mm or larger and 20 mm or smaller. When the bending depth h is within this range, distortion of printing is small, and a precise printed layer can be obtained. The "bending depth h" refers to a distance between a line segment connecting two end portions and a tangential line that is tangent to the bent portion 13 and parallel to the line segment, in a cross-sectional view in a thickness direction of the bent plate 10. In the bent plate 10 illustrated in FIG. 3A and FIG. 3B, the bending depth h means a distance between both ends of the bent plate 10 in a bent direction (a Z-direction in FIG. 3A and FIG. 3B).

The bent plate 10 is preferably prepared by forming a flat plate into a predetermined shape. For example, in the case where plate glass is selected as the flat plate, a desired forming method, a vacuum forming method, and a press forming method, depending on the shape of the formed bent plate 10 made of glass (hereinafter, also simply abbreviated to bent glass).

The self-weight forming method is a method in which plate glass is placed on a predetermined mold corresponding to the shape of the formed bent glass 10, the plate glass is then softened and the plate glass is bent by gravity so as to fit into the mold, thereby forming it into a predetermined shape.

The vacuum forming method is a method, in which differential pressure is applied to front and back surfaces of plate glass in a state where the plate glass is softened, and the plate glass is bent so as to fit into a mold, thereby forming it into a predetermined shape. In the vacuum forming method, plate glass is placed on a predetermined lower mold corresponding to the shape of the formed bent glass 10, another mold such as a mold for clamping is provided above the plate glass, the periphery of the plate glass is sealed, and then the pressure of a space between the lower mold and the plate glass is reduced by a pump, thereby applying differential pressure to the front and back surfaces of the plate glass. At this time, pressure may be supplementally exerted to an upper surface side of the plate glass.

The press forming is a method, in which plate glass is placed between predetermined molds (a lower mold and an upper mold) corresponding to the shape of the formed bent glass 10, a press load is applied to the upper and lower molds in a state where the plate glass is softened, and the plate glass is bent so as to fit into the molds, thereby forming it into a predetermined shape.

The vacuum forming method, out of these methods, is excellent as a method to form the bent glass 10 into a predetermined shape. Furthermore, in the vacuum forming method, an unevenness defect, such as a scratch and a dent, can be decreased since the bent glass 10 can be formed without bringing one main surface, out of the two main surfaces of the bent glass 10, into contact with a mold.

In addition, a locally heating and forming method, or a differential pressure forming method other than the vacuum forming method, can also be used. An appropriate forming method may be selected depending to the shape of the formed bent glass 10, and also two or more types of forming methods may be used in combination.

On the formed bent glass, a treatment of reducing a residual stress may be performed by reheating (anneal treatment). An outer peripheral end surface of the bent glass 10 may be subjected to a general C-chamfering or R-chamfering, or the bent glass 10 may be punched. In addition, plate glass having an etched layer or a coated layer, which is obtained by wet coating or dry coating, may be used as flat plate glass to be used.

<Fixing Jig>

The fixing jig 20 has a surface 21 formed in a shape corresponding to the lower surface 12 of the bent plate 10. A recessed space 24 is provided in a lower surface 22 of the fixing jig 20. The recessed space 24 communicates with the surface 21 by means of a plurality of suction holes 23 opened to the surface 21. The recessed space 24 is connected to a vacuum device (not illustrated), and air is sucked from the suction holes 23 via the recesses space 24 such that the bent plate 10 is vacuum-sucked onto the surface 21 of the fixing jig 20. Although the surface 21 of the fixing jig 20 is formed so as to fix the bent plate 10 such that a concave shape of the bent portion 13 faces the upper surface 11 of the bent plate 10 in the present embodiment, it may be formed such that a convex shape of the bent portion 13 face the upper surface 11.

As for the fixing jig 20, materials softer than the bent plate 10, for example, carbon and resins, can be used. As for resins, for example, Bakelite (registered trademark), PEEK (registered trademark), vinyl chloride, Duracon (registered trademark), and the like can be used. These resins may be subjected to a surface treatment with the use of a conductive film for imparting conductivity, or may be mixed with a conductivity imparting agent such as carbon. The fixing jig 20 has a volume resistivity of preferably $10^9$ Ωm or lower, and more preferably $10^7$ Ωm or higher and $10^8$ Ωm or lower. When the fixing jig 20 has a volume resistivity within such a range, the occurrence of static electricity, which occurs at the time of performing printing, is impeded, and thus plate releasing of the screen plate 30 (described later) from the upper surface 11 that is a print surface becomes better. Furthermore, the stopping of printing materials such as an ink becomes better, and printing accuracy can be improved without contaminating the screen plate 30 and the fixing jig 20. In addition, since static electricity can be reduced, a quality printed layer can be formed without drawing foreign substances such as dust.

Figure 7:
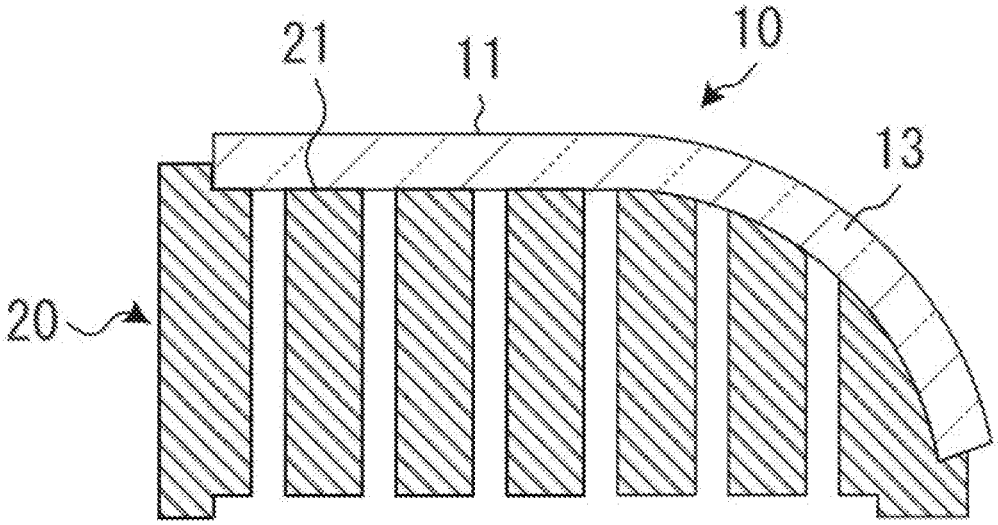
FIG. 7 is a cross-sectional view illustrating a bent glass having a bent portion of a convex shape along with a fixing jig.

A case where printing is performed on the convex surface shape of the bent portion of the bent glass is illustrated in FIG. 7. In this embodiment, the surface 21 of the fixing jig 20 is formed so as to fix the bent plate 10 such that the convex shape of the bent portion 13 faces the upper surface 11 of the bent plate 10.

In addition, a cavity 25 is formed in an upper surface of the fixing jig 20 at a position where an end surface 15 of the bent plate 10 passes. The lower surface 12 of the bent plate 10 partially faces an opening side of the cavity 25. The cavity 25 is provided for the purpose of removing the bent plate 10 from the fixing jig 20 by putting a hand of a spatula in and lifting the bent plate 10 after printing without touching the print surface. For this reason, the cavity 25 has a size which allows a hand or a spatula to be inserted, and is formed along the end surface 15 of the bent plate 10 in the present embodiment.

Furthermore, a positioning mechanism, such as a counterbore, into which the bent plate 10 is fit, and an abutting portion 26, which can fix at least one end surface of the bent plate 10, may be provided on the upper surface of the fixing jig 20. When the fixing jig 20 has such a positioning mechanism, a fix position of the bent plate 10 with respect to the screen plate 30 is determined with good reproducibility, a bent plate with a printed layer which is excellent in print position accuracy can be produced efficiently by fine-tuning a screen plate mounting position. In addition, the bent plate 10 positioned outside the fixing jig 20 in advance may be disposed at an accurate position on the fixing jig 20 by using a robot hand or the like.

<Screen Plate>

As illustrated in FIG. 2A as well, the screen plate 30 contains a rectangular frame 31, and a screen 34 that is stretched by the frame 31 at constant tension, includes a printing pattern portion 32 and a non-printing pattern portion 33 (a first non-printing pattern portion 331 and a second non-printing pattern portion 332), and is disposed above the bent plate 10 with a predetermined clearance.

The printing pattern portion 32 includes an ink permeable region 35, and refers to a part where the squeegee 40 passes the ink permeable region 35 when the squeegee 40 is caused to traverse, as will be described later. The non-printing pattern portion 33 is formed by an ink non-permeable region 36, and refers to a part where the squeegee 40 does not pass the ink permeable region 35.

As for the screen 34, use can be made of a sheet-like gauze that has flexibility and has a fine mesh through which an ink is likely to permeate. Resins such as tetoron, nylon, and polyester, and metals such as stainless steel, can be used as materials of the screen 34.

As an example of the screen 34 that has such an ink permeable region 35 and an ink non-permeable region 36, a mixed plate illustrated in FIG. 2B may be used. In this mixed plate, a gauze 34*a* that is made of stainless steel and is used n a region including the ink permeable region 35 is surrounded by a gauze 34*b* that is made of resins such as tetoron and is used in the ink non-permeable region 36. According to such a mixed plate, the screen 34 can be made so as to have a bent shape corresponding to the shape of the upper surface 11 serving as the surface to be printed of the bent plate 10, and the printed layer can be formed more accurately.

<Squeegee>

The squeegee 40 is provided above the screen 34, is movable in a horizontal direction and in a vertical direction, and is rotatable about a horizontal axis orthogonal to a direction in which the squeegee 40 relatively traverses the bent plate 10 (a right and left direction in FIG. 1). An ink is applied to the surface to be printed (the upper surface 11) of the bent plate 10 via the screen 34 by pressing and deflecting the screen 34 by the squeegee 40 in the vertical direction and relatively and horizontally moving the squeegee 40 with respect to the bent plate 10. It is preferable that a print thickness obtained with the applied ink 20 μm or smaller in terms of the thickness of the dried printed layer. The print thickness can be adjusted through the mesh opening degree (roughness of opening) of the gauze of the screen plate 30.

<Manufacturing Method for Bent Plate with Printed Layer>

Next, the manufacturing method for a bent plate with a printed layer will be described.

As illustrated in (a) of FIG. 1, in the manufacturing method for a bent plate with a printed layer of the present embodiment, the bent plate 10, which is a printing target, the fixing jig 20 that has the surface 21 that fixes and holds the bent plate 10, the screen 34 that is fixed to the frame 31 and has the printing pattern portion 32 and the non-printing pattern portion 33, an ink, and the squeegee 40 provided above the screen 34 are prepared.

The lower surface 12 of the bent plate 10 is brought into contact with the surface 21 of the fixing jig 20 and the position of the bent plate 10 is determined by means of the abutting portion 26. After that, the vacuum device (not illustrated) is operated to suck air from the suction holes 23 via the recessed space 24 so that the bent plate 10 is vacuum-sucked onto the surface 21 of the fixing jig 20, thereby fixing the bent plate 10 to the fixing jig 20. In addition, after the screen 34 is disposed above the bent plate 10 with the screen 34 being separated from the upper surface 11 of the bent plate 10, the ink is supplied onto the screen 34. The supplied ink is spread on the screen 34 by a scraper (not illustrated).

Next, the screen 34 is pressed and deflected by the squeegee 40, and the squeegee 40 and a printing start part P of the bent plate 10 are brought into contact with each other via the screen 34.

Herein, an angle that is formed by a surface S of the screen 34 in a state of no contact with the squeegee 40 and a center line L of the squeegee 40 and that is on a moving direction side of the squeegee and opposite to the bent plate 10 is referred to as a squeegee angle α. The squeegee angle α when the squeegee 40 and the printing stars part P of the bent plate 10 are in contact with each other via the screen 34 is referred to as an angle $\alpha_1$.

In addition, an angle that is on the moving direction side and is formed by a tangential line TL at a position on the upper surface 11 of the bent plate 10 at which the squeegee 40 is in contact therewith via the screen 34 and the center line L of the squeegee 40 is referred to as a contact angle β between the squeegee 40 and the bent plate 10. The contact angle β when the squeegee 40 and the printing start part P of the bent plate 10 are in contact with each other is referred to as an angle $\beta_1$.

Then, as illustrated in (b) of FIG. 1, the squeegee 40 is moved in the horizontal direction (the right and left direction of FIG. 1) along the upper surface 11 of the bent plate 10 and is also moved in the vertical direction with the bent plate 10 and the screen plate 30 being fixed so that the ink is extruded from the screen 34 so as to be applied to the upper surface 11 while the squeegee 40 deflects the screen 34. Accordingly, the squeegee 40 starts printing from the printing start part P, and moves to the non-printing pattern portion 33 after passing the printing pattern portions 32 while moving the horizontal direction and the vertical direction.

Although the squeegee angle $\alpha$ in a printing step is the constant angle $\alpha_1$ during the squeegee 40 traverses above the printing pattern portion 32 (refer to (b) of FIG. 1), the squeegee angle $\alpha$ is changed to a larger angle $\alpha_2$ in the non-printing pattern portion 33 or a printing termination portion (the end surface 15 of the bent plate 10) (refer to (c) of FIG. 1). As described above, by operating the squeegee 40 such that the squeegee angle $\alpha$ becomes larger in the non-printing pattern portion 33, ink splashing on an edge between the upper surface 11 and the end surface 15 of the bent plate 10 can be suppressed and printing quality on the end surface is improved. In addition, the contamination of the fixing jig 20 in the vicinity of the end surface 15 of the bent plate 10, which is caused by ink splashing, can be prevented.

In the present embodiment, since the printing pattern portion 32 is printed up to the edge between the upper surface 11 and the end surface 15 of the bent plate 10, a boundary portion between the printing pattern portion 32 and the non-printing pattern portion 33 substantially matches the edge between the upper surface 11 and the end surface 15 of the bent plate 10.

During the squeegee 40 moves above the printing pattern portion 32, the contact angle $\beta$ between the squeegee 40 and the bent plate 10 gradually changes since the direction of the tangential line TL with respect to the bent plate 10 changes, although the squeegee angle $\alpha$ remains constant at the angle $\alpha_1$. That is, the contact angle $\beta$ changes from the angle $\beta_1$ to an angle $\beta_2$ in the bent portion 13 in an example illustrated in FIG. 1. In addition, the contact angle $\beta$ becomes $\beta_3$ that is larger than $\beta_2$, in the non-printing pattern portion 33 or the printing termination portion (the end surface 15 of the bent plate 10). The constant angle described herein is an angle that includes variations in an industrially acceptable range.

In addition, the ink extruded and printed onto the upper surface 11 of the bent plate 10 may be cured by a heat treatment. In the case of a UV curable ink, the ink may be cured by a UV treatment.

As described above, according to the manufacturing method for a bent plate with a printed layer of the present embodiment, the bent plate 10 that has the upper surface 11 and the lower surface 12 and has the bent portion 13 on at least a part thereof, the fixing jig 20 that has the surface 21 having a shape corresponding to the lower surface 12, the screen plate 30 that has the printing pattern portion, the ink, and the squeegee 40 are used. Furthermore, the lower surface 12 is brought into contact with the surface 21 so that the bent plate 10 is held by the fixing jig 20, and the ink is supplied onto the screen 34 which is disposed above the bent plate 10 with the screen 34 being separated from the upper surface 11. After the squeegee 40 and the printing start part P of the bent plate 10 are brought into contact with each other via the screen 34, the squeegee 40 is caused to relatively traverse the bent plate 10 along the upper surface 11 and the ink is extruded from the screen 34 so as to form a printed layer.

In addition, the screen 34 includes the printing pattern portion 32 and the non-printing pattern portion 33, and the squeegee angle $\alpha$ is changed to the larger angle $\alpha_2$ in the non-printing pattern portion 33 when the squeegee 40 is caused to relatively traverse the bent plate 10, in particular, when the squeegee 40 moves from the printing pattern portion 32 to the non-printing pattern portion 33. Therefore, ink splashing on the boundary portion between the printing pattern portion 32 and the non-printing pattern portion 33 is suppressed and printing quality is improved. In addition, the contamination of the fixing jig 20 in the vicinity of the end surface 15 of the bent plate 10, which is caused by ink splashing, can be prevented.

Specifically, it is preferable that the squeegee angle $\alpha$ is changed to the angle $\alpha_2$ which is larger than the angle $\alpha_1$ in the printing pattern portion 32 before moving to the non-printing pattern portion 33.

Furthermore, since the squeegee angle $\alpha$ is made constant until the squeegee 40 traverses above the printing pattern portion 32 when the squeegee 40 moves from the printing pattern portion 32 to the non-printing pattern portion 33, the squeegee 40 can be with a simple drive mechanism.

In addition, since printing is performed by deflecting the screen 34 by the squeegee 40 until the screen 34 comes into contact with the upper surface 11 of the bent plate 10, plate releasing after printing is good and the contamination of a print surface can be prevented.

The thickness of the ink extruded on the upper surface 11 is preferably 20 μm or smaller. That is because a sufficient light shielding effect is obtained with only one-layer printing and the number of pinholes can be decreased. The "thickness of the ink" described herein is a value measured after the ink is fixed by drying or the like.

In addition since the lower surface 12 is vacuum-sucked onto the surface 21 and the bent plate 10 is held by the fixing jig 20, the bent plate 10 can be stably held by the fixing jig 20.

In addition, since the upper surface 11 is in a concave shape and thus the gauze of the screen plate 30 is unlikely to come into contact with the upper surface 11 that is a surface to be printed, the surface to be printed in a concave shape can also be printed with good printing accuracy.

In addition, since a step in which the ink extruded on the upper surface 11 is cured by a heat treatment is further included, the ink is solidly fixed to the surface to be printed in a short period of time and production efficiency is improved.

Each of steps of disposing the screen 34 above the bent plate 10, supplying an ink onto the screen 34, bringing the squeegee 40 into contact with the printing start part P of the bent plate 10 via the screen 34, and causing the squeegee 40 to relatively traverse the bent plate 10 to form a printed layer may be carried out two or more times without being limited to carrying out each step one time. By carrying out these steps two or more times, for example, two-layer printing including printing of a display pattern portion and a light shielding portion which prevents transmission of backlight, is possible. In addition, by performing two-layer printing, the generation of a pinhole in a printed layer, which is caused by ink failing, can be suppressed and a light shielding effect can be enhanced. In the case where two-layer printing is carried out, the screen plate 30 used for a first layer and the screen plate 30 used for a second layer may be the same with or may be different from each other.

In addition, since the squeegee 40 is moved so as to perform printing in a state where the bent plate 10 and the screen plate 30 are fixed, a mechanism to drive the bent plate 10 or the screen plate 30 is not required and the simplification of the printing apparatus is achieved.

In the above embodiment, in the step of forming a printed layer, the squeegee 40 is caused to relatively traverse the bent plate 10 from the end portion on a flat portion 14 side to the end portion on a bent portion 13 side so as to perform printing, in a moving direction of the squeegee 40 (the right and left direction of FIG. 1). That is, in the state where the tangential line TL at the position of the upper surface 11 of the bent plate 10 with which the squeegee 40 is in contact via the screen 34 is parallel to the surface S of the screen 34, which is in a state of no contact with the squeegee 40, on the printing start part P, screen-printing can be stably carried out, and thus this state is preferable regardless of the presence or absence of the flat portion 14.

Figure 4:
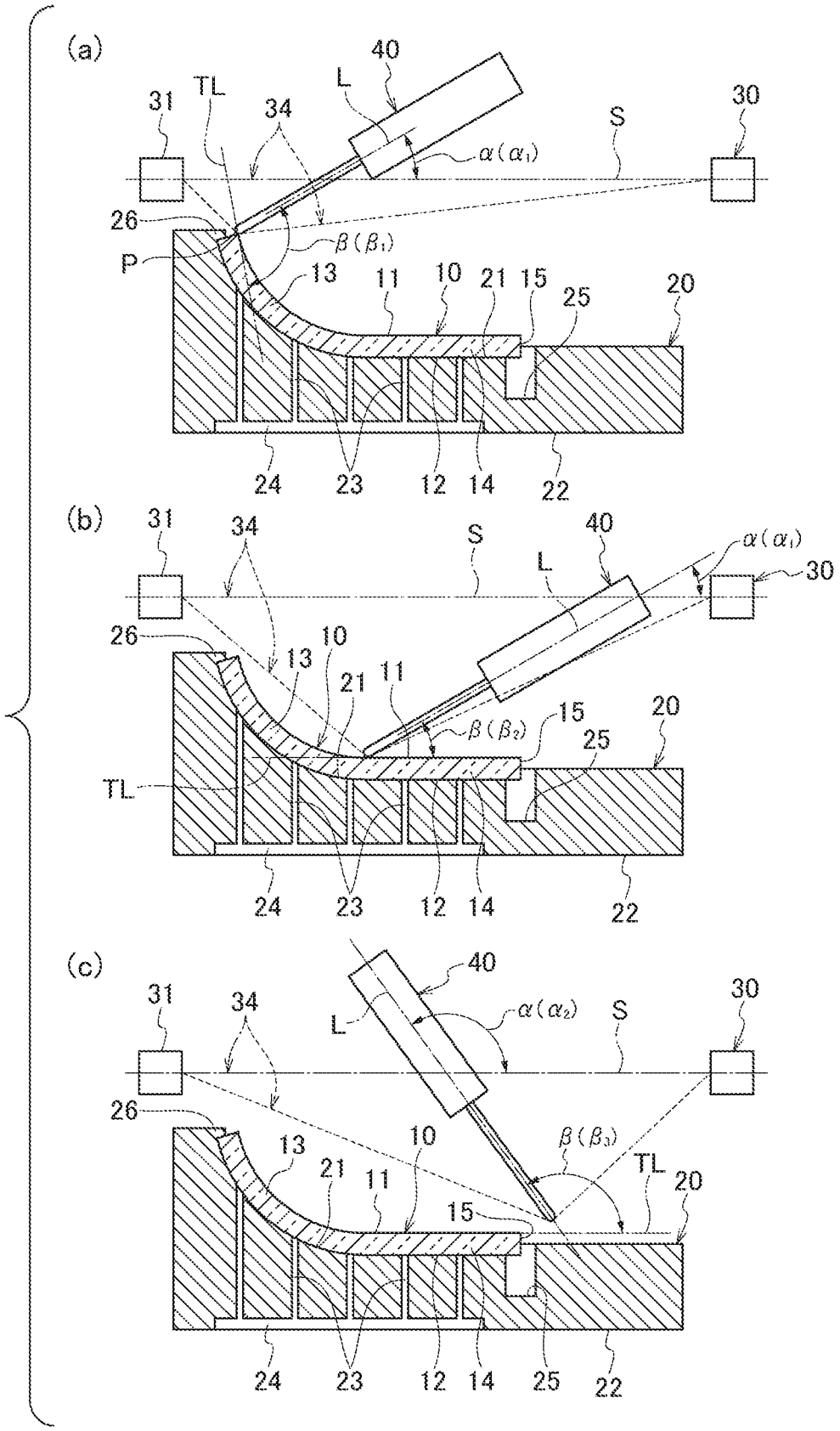
FIG. 4 includes cross-sectional views (a) to (c) illustrating procedures of a manufacturing method for a bent plate with a printed layer according to a modification example of the first embodiment of the present invention.

However, as in a modification example of the present embodiment illustrated in FIG. 4, the squeegee 40 may be caused to relatively traverse the bent plate 10 from the end portion on the bent portion 13 side to the end portion on the flat portion 14 side so as to perform printing. Accordingly, in this case, the squeegee 40 is brought into contact with the printing start part P of the bent plate 10 via the screen 34 with the end portion on the bent portion 13 side being as the printing start part P of the bent plate 10, and the squeegee 40 is caused to relatively traverse the bent plate 10 to form a printed layer.

In this case as well, although the squeegee angle $\alpha$ in the printing step is the constant angle $\alpha_1$ during the squeegee 40 traverses above the printing pattern portion 32 (refer to (b) of FIG. 4), the squeegee angle $\alpha$ is changed to the larger angle $\alpha_2$ in the non-printing pattern portion 33 or the printing termination portion (the end surface 15 of the bent plate 10) (refer to (c) of FIG. 4). As described above, by operating the squeegee 40 such that the squeegee angle $\alpha$ becomes larger in the non-printing pattern portion 33, ink splashing on the edge between the upper surface 11 and the end surface 15 of the bent plate 10 is suppressed and printing quality is improved. In addition, the contamination of the fixing jig 20 in the vicinity of the end surface 15 of the bent plate 10, which is caused by ink splashing, can be prevented.

In the case where the printing direction is as illustrated in FIG. 4, it is preferable that the abutting portion 26 be provided on a downstream side of the bent plate 10 (i.e., the end portion on the flat portion 14 side) with respect to the moving direction of the squeegee 40. Although the cavity 25 is visible since (a) to (c) of FIG. 4 are cross-sectional views, the abutting portion 26 may be formed, for example, at both ends of the cavity 25 in a direction from the upper surface to the lower surface of the drawing sheet in and axial direction. In addition, a groove to which the bent plate 10 is fitted may be formed.

Second Embodiment

Next, a second embodiment of the present invention will be described with reference to FIG. 5. A manufacturing method for a bent plate with a printed layer of the second embodiment is different from the first embodiment in that the contact angle between the squeegee and the bent plate is kept constant during the squeegee traverses above the printing pattern portion of the screen. Since the other portions are the same as those of the first embodiment, the same portions will be assigned with the same reference signs or corresponding reference signs and description thereof will be simplified or omitted.

In the manufacturing method for a bent plate with a printed layer of the present embodiment, the squeegee 40 is moved so as to perform printing in a state where the bent plate 10 and the screen plate 30 are fixed as in the first embodiment. However, in this embodiment, the contact angle $\beta$ between the squeegee 40 and the bent plate 10 is kept at the constant angle $\beta_1$ from the printing start part P when the squeegee 40 is caused to relatively traverse the bent plate 10.

The moving direction of the squeegee 40 is the same as that of the modification example of the first embodiment illustrated in FIG. 4.

For this reason, the squeegee angle $\alpha$ gradually changes with a change in the shape of the bent plate 10. In an example illustrated in FIG. 5, the squeegee angle $\alpha$ changes to $\alpha_1$, to $\alpha_2$, and to $\alpha_3$ in the order of (a), (b) and (c). Accordingly, the squeegee 40 moves horizontally, moves vertically, and rotates so as to keep the contact angle $\beta$ constant. Therefore, since a pressing force of the squeegee 40 exerted on the bent plate 10 is kept substantially constant, the thickness of the applied ink is almost the same and thus, a bent plate with a printed layer in which the thickness of the printed layer is uniform can be obtained.

At this time, it is preferable that the printing start part P is in the first non-printing pattern portion 331, and it is also preferable that an angle on the moving direction side of the squeegee 40 be started to change in the first non-printing pattern portion 331 when the squeegee 40 moves form the first non-printing pattern portion 331 to the printing pattern portion 32. At a time point when the angle on the moving direction side of the squeegee 40 is started to change, the quality of a printed layer may be adversely affected in some cases such that a local difference in level is generated in the printed layer due to vibration, or the like. By starting to change the angle on the moving direction side of the squeegee 40 in the first non-printing pattern portion 331, the effect on the printed layer can be reduced and a bent plate with a printed layer with high accuracy can be obtained.

Figure 5:
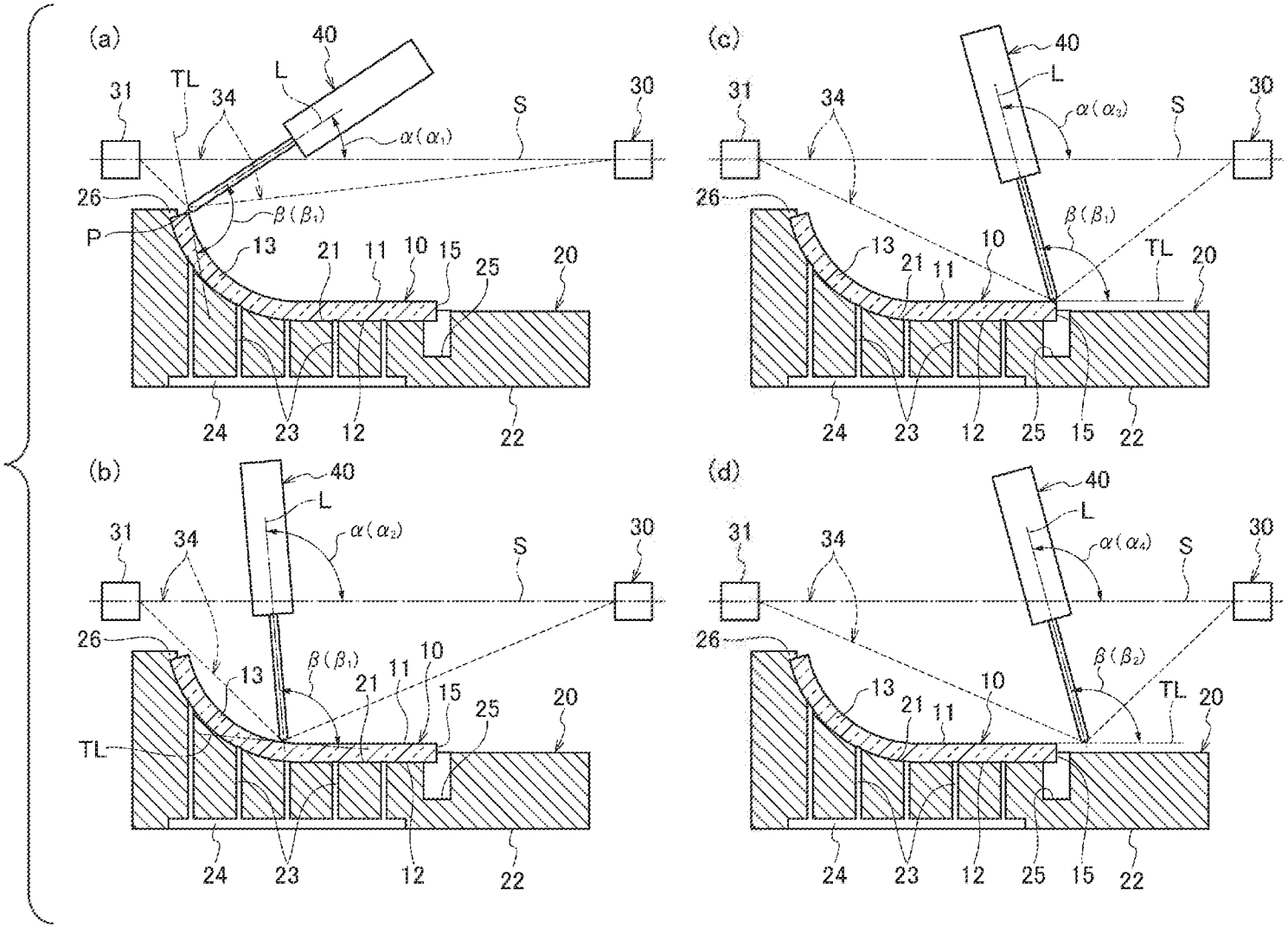
FIG. 5 includes cross-sectional views (a) to (d) illustrating procedures of a manufacturing method for a bent plate with a printed layer according to a second embodiment of the present invention.

Also in the present embodiment, the squeegee angle $\alpha$ may be changed to a larger angle $\alpha_4$ (refer to (d) of FIG. 5) in the non-printing pattern portion 33 or the printing termination portion (the end surface 15 of the bent plate 10) as in the first embodiment. In this case, the contact angle $\beta$ becomes $\beta_2$, which is larger than $\beta_1$. However, in the case where the squeegee angle $\alpha$ is an angle $\alpha_3$, and the angle $\alpha_3$ is large enough to suppress ink splashing near a boundary between the printing pattern portion 32 and the non-printing pattern portion 33, the angle $\alpha$ may be maintained at the angle $\alpha_3$ even in the non-printing pattern portion 33 after the printing pattern portion 32. That is, the contact angle $\beta$ is also maintained at the angle $\beta_1$ in this case.

Accordingly, in the manufacturing method for a bent plate with a printed layer of the second embodiment, printing can be performed with a uniform print thickness since the contact angle $\beta$ is kept at the constant angle $\beta_1$ at least until the squeegee 40 traverses above the printing pattern portion 32. Also in this embodiment, it is preferable that thought it is not particularly limited, the print thickness of an ink extruded on the upper surface 11 is 20 μm or smaller as a value measured after the ink is fixed by drying or the like.

Third Embodiment

Next, a third embodiment of the present invention will be described with reference to FIG. 8. A manufacturing method for a bent plate with a printed layer of the third embodiment is different from the first embodiment and the second embodiment in that the squeegee angle $\alpha$ is controlled such that the contact angle between the squeegee and the bent plate follows a certain rule during the squeegee traverses above the printing pattern portion of the screen. Since other portions are the same as those of the first embodiment and the second embodiment, the same portions will be assigned with the same reference signs or corresponding reference signs and description thereof will be simplified or omitted.

In the manufacturing method for a bent plate with a printed layer of this embodiment, the squeegee 40 is moved so as to perform printing in a state where the bent plate 10 and the screen plate 30 are fixed as in the first embodiment and the second embodiment. However, in the present embodiment, the squeegee angle $\alpha$ is controlled such that a difference $\Delta\beta'$ between a maximum value and a minimum value of the contact angle $\beta$ between the squeegee 40 and the bent plate 10 when the squeegee 40 is caused to relatively traverse the bent plate 10 is small as compared to a difference $\Delta\beta$ between a maximum value and a minimum value of the contact angle $\beta$ when the squeegee 40 is caused to relatively traverse the upper surface 11 of the bent plate 10 with the squeegee angle $\alpha$ kept constant.

The moving direction of the squeegee 40 is the same as that of the first embodiment illustrated in FIG. 1.

Figure 8:
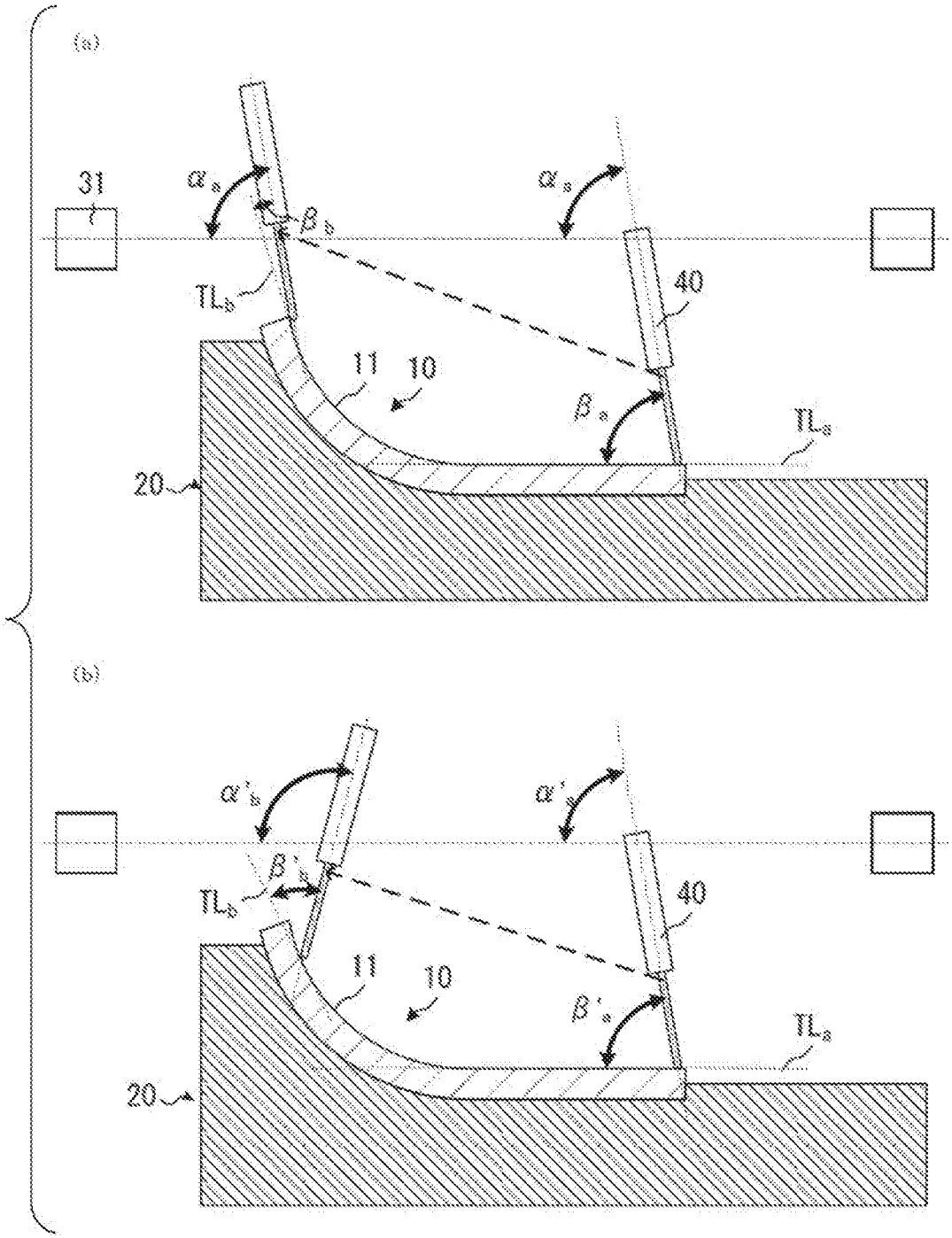
FIG. 8 includes cross-sectional views (a) and (b) illustrating procedures of a manufacturing method for a bent plate with a printed layer according to a third embodiment of the present invention.

As illustrated in (a) of FIG. 8, in the case where the squeegee angle $\alpha$ is kept constant at $\alpha_a$, when the maximum value of the contact angle $\beta$ is set to $\beta_a$ and the minimum value of the contact angle $\beta$ is set to $\beta_b$, the difference $\Delta\beta$ between these values is obtained by $\beta_a$-$\beta_b$. In the third embodiment, the squeegee angle $\alpha$ is controlled such that the difference $\Delta\beta'$ in the contact angle $\beta$ is smaller than $\Delta\beta$. As illustrated in (b) of FIG. 8, the difference $\Delta\beta'$ in the contact angle $\beta$ is obtained by a difference between a maximum value $\beta'_a$ and a minimum value $\beta'_b$ of the contact angle $\beta$. The squeegee angle $\alpha$ is changed from $\alpha'_a$ to $\alpha\alpha_b$ in (b) of FIG. 8 such that this $\Delta\beta'$ becomes smaller than $\Delta\beta$.

By controlling the squeegee angle $\alpha$ in this manner, uniformity in the thickness of a printed layer between a flat portion and a bent portion improves as compared to the case where printing is performed with the squeegee angle $\alpha$ being kept constant. In addition, such a precise control for keeping the constant angle $\beta$ constant is not necessary, and load for a printing apparatus or production can be reduced.

In this case, it is preferable that a change in the squeegee angle $\alpha$ be continuously controlled. In a case where the squeegee angle $\alpha$ is changed intermittently, it is conceivable that vibration at the timing when the change is started has an effect on the thickness of a printed layer or the like, but by continuously controlling the squeegee angle $\alpha$, vibration can be suppressed and a high-quality printed layer can be formed.

In addition, it is preferable that the squeegee angle $\alpha$ be controlled so as to become larger. Plate releasing in the end portion of the bent plate 10 is good and a high-quality bent plate with a printed layer can be obtained.

The contact angle $\beta$ is preferably 60 degrees or larger and 90 degrees or smaller. It is easy to control the squeegee angle $\alpha$ and a high-quality bent plate with a printed layer can be obtained.

The present invention is not limited to each of the embodiments described above and can be appropriately modified and improved.

The bent plate 10 and the screen plate 30 are fixed and the squeegee 40 is moved so as to perform printing in the first, second, and third embodiments. However, the squeegee 40 may be fixed in the horizontal direction and the bent plate 10 and the screen plate 30 may be moved in the horizontal direction so as to perform printing, as in a modification example illustrated in FIG. 6. In this case, the squeegee 40 moves vertically and rotates.

Figure 6:
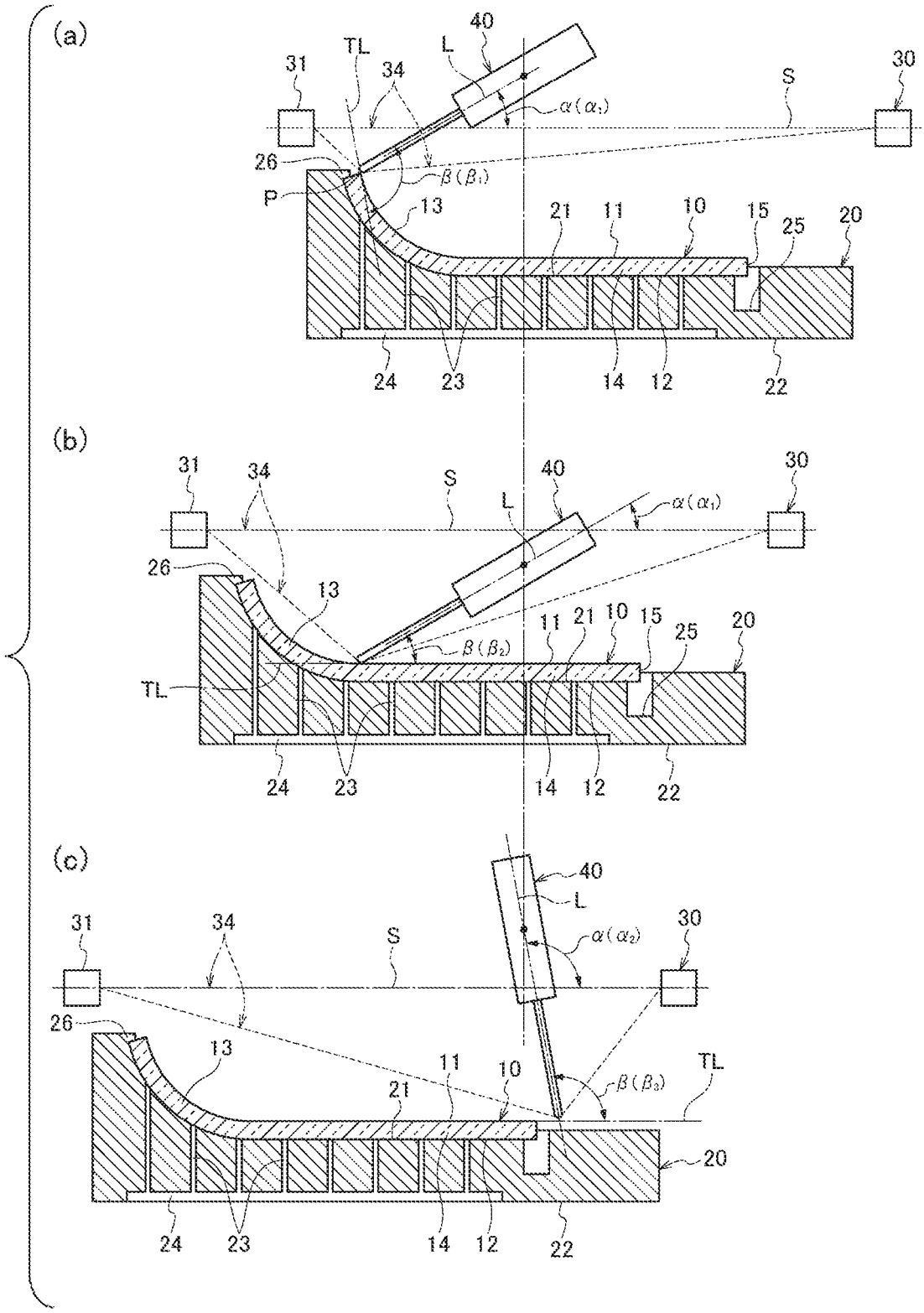
FIG. 6 includes cross-sectional views (a) to (c) illustrating procedures of a manufacturing method for a bent plate with a printed layer according to a modification example of the present invention.

The case where the squeegee angle $\alpha$ is changed so as to become larger in the non-printing pattern portion 33 as in the first embodiment has been described in the modification example illustrated in FIG. 6. However, this modification example can be applied to the case where the squeegee angle $\alpha$ is changed such that the contact angle $\beta$ is kept constant or follows a certain rule as in the second embodiment or in the third embodiment.

In addition, the present invention may be configured such that the squeegee 40, the bent plate 10, and the screen plate 30 are simultaneously moved in the horizontal direction so as to perform printing. At this time, the angle of the bent plate 10 may be changed in a range where the bent plate 10 does not come into contact with the screen 34. In this case, the angle of the fixing jig 20 may be changed so as to indirectly change the angle of the bent plate 10.

In addition although the case of changing the squeegee angle $\alpha$ so as to become larger in the non-printing pattern portion 33 and the case of changing the squeegee angle $\alpha$ such that the contact angle $\beta$ is kept constant or follows a certain rule have been described in the above embodiments, the present invention is not limited thereto. That is, as long as the angle $\alpha$ on the moving direction side of the squeegee 40 where the angle is formed by the surface S of the screen 34 in a state of no contact with the squeegee 40 and the squeegee 40 in the side view is changed when the squeegee 40 is caused to relatively traverse the bent plate 10, the method is included in the present invention. Accordingly, as long as the squeegee 40 is rotated about the horizontal axis orthogonal to a direction where the squeegee 40 relatively traverses the bent plate 10 when the squeegee 40 is caused to relatively traverse the bent plate 10, the method is included in the present invention.

In addition, without being limited to the bent plate of the above embodiments, the bent plate 10 of the present invention may have a shape of a bent plate that is formed of only the bent portion 13, a bent plate that includes a plurality of bent portions 13 or the like. In particular, the manufacturing method of the present invention is effective even in the plurality of bent portions 13 having a combination of a concave shape and a convex shape.

While the present invention has been described in detail and with reference to specific embodiment thereof, it will be apparent to one skilled in the art that various changes and modifications can be made therein without departing from the spirit and scope thereof.

The present application is based on Japanese Patent Application (No. 2016-127637) filed on Jun. 28, 2016 and Japanese Patent Application (No. 2017-123691) filed on Jun. 23, 2017, and the contents thereof are incorporated herein by reference.

DESCRIPTION OF REFERENCE NUMERALS AND SIGNS

10 bent plate
11 upper surface (first main surface)
12 lower surface (second main surface)
13 bent portion
20 fixing jig
21 surface
30 screen plate
31 frame
34 screen 40 squeegee α squeegee angle β contact angle P printing start part S surface of screen plate in a state of no contact with squeegee XL tangential line at a position on first main surface at which squeegee is in contact with the first main surface via screen

What is claimed is:

1. A method for manufacturing a bent plate with a printed layer, comprising:

providing a bent plate having a first main surface, a second main surface and a bent portion;

bringing the second main surface of the bent plate into contact with a surface of a fixing jig having a shape corresponding to the second main surface such that the bent plate is held on the surface of the fixing jig;

disposing a screen having a printing pattern portion above the bent plate such that a surface of the screen has a plane separated from the first main surface of the bent plate;

supplying an ink onto the screen;

pressing a squeegee against the surface of the screen such that the screen is deflected until the screen comes into contact with the first main surface of the bent plate and that the squeegee brings a part of the screen into contact with a printing start part of the bent plate and forms a squeegee angle between a center line of the squeegee and the plane of the surface of the screen on a moving direction side of the squeegee; and extruding the ink from the screen by causing the squeegee to relatively traverse the bent plate along the first main surface via the screen such that a printed layer is formed on at least a part of the first main surface of the bent plate, wherein the extruding of the ink includes changing the squeegee angle.

2. The method according to claim 1, wherein the screen comprises the printing pattern portion and a non-printing pattern portion, and the extruding of the ink includes changing the squeegee angle such that the squeegee angle is changed in the non-printing pattern portion when the squeegee moves from the printing pattern portion to the non-printing pattern portion.

3. The method according to claim 2, wherein the extruding of the ink includes changing the squeegee angle such that the squeegee angle becomes larger in the non-printing pattern portion than the squeegee angle in the printing pattern portion.

4. The method according to claim 3, wherein the extruding of the ink includes changing the squeegee angle such that the squeegee angle on the moving direction side of the squeegee is kept constant until the squeegee traverses above the printing pattern portion.

5. The method according to claim 2, wherein the extruding of the ink includes changing the squeegee angle such that the squeegee angle on the moving direction side of the squeegee is kept constant until the squeegee traverses above the printing pattern portion.

6. The method according to claim 1, wherein the extruding of the ink includes changing the squeegee angle such that the squeegee angle is changed when the squeegee is caused to relatively traverse the bent plate and moves in the printing pattern portion and that a difference Δβ' between a maximum value and a minimum value of a contact angle on the moving direction side is smaller than a difference Δβ between a maximum value and a minimum value of the contact angle on the moving direction side where the contact angle is formed between the center line of the squeegee and a tangential line on the first main surface when the squeegee angle is kept constant.

7. The method according to claim 6, wherein the extruding of the ink includes changing the squeegee angle such that the squeegee angle is changed continuously.

8. The method according to claim 6, wherein the extruding of the ink includes changing the squeegee angle such that the squeegee angle becomes larger.

9. The method according to claim 6, wherein the contact angle is in a range of 60 degrees to 90 degrees.

10. The method according to claim 1, wherein the extruding of the ink includes changing the squeegee angle such that a contact angle on the moving direction side is kept constant where the contact angle is formed between the center line of the squeegee and a tangential line on the first main surface.

11. The method according to claim 10, wherein the screen comprises a first non-printing pattern portion, the printing pattern portion, and a second non-printing pattern portion such that the printing start part is opposite to the first non-printing pattern portion, and the extruding of the ink includes changing the squeegee angle such that the squeegee angle starts to change in the first non-printing pattern portion when the squeegee moves from the first non-printing pattern portion to the printing pattern portion.

12. The method according to claim 1, wherein the screen comprises the printing pattern portion and a non-printing pattern portion, and the extruding of the ink includes changing the squeegee angle such that a contact angle on the moving direction side is kept constant until the squeegee traverses above the printing pattern portion where the contact angle is formed between the center line of the squeegee and a tangential line on the first main surface, and that the squeegee angle becomes larger in the non-printing pattern portion, when the squeegee moves from the printing pattern portion to the non-printing pattern portion.

13. The method according to claim 1, wherein the ink extruded on the first main surface of the bent plate has a thickness of 20 μm or smaller when the printed layer is dried.

14. The method according to claim 1, wherein the bringing of the second main surface of the bent plate into contact with the surface of the fixing jig includes vacuum-sucking the second main surface of the bent plate onto the surface of the fixing jig to hold the bent plate on the fixing jig.

15. The method according to claim 1, wherein the first main surface of the bent plate has a concave shape.

16. The method according to claim 1, wherein the first main surface of the bent plate has a convex shape.

17. The method according to claim 1, wherein the bent portion of the bent plate has a radius of curvature of 10,000 mm or smaller.

18. The method according to claim 1, wherein the bent portion of the bent plate has a radius of curvature of 1 mm or larger.

19. The method according to claim 1, further comprising:

curing the ink extruded on the first main surface of the bent plate.

20. The method according to claim 19, wherein the curing of the ink includes applying a heat treatment to the ink.

21. The method according to claim 1, further comprising;

repeating the disposing, supplying, pressing and extruding at least twice.

22. The method according to claim 1, wherein the extruding of the ink includes moving the squeegee relative to the bent plate in a fixed position.

23. The method according to claim 1, wherein the extruding of the ink includes moving the bent plate relative to the squeegee in a fixed position.

24. The method according to claim 1, wherein the extruding of the ink includes moving the bent plate and the squeegee relative to each other.

* * * * *